US006458172B1

(12) United States Patent
Macduff et al.

(10) Patent No.: US 6,458,172 B1
(45) Date of Patent: Oct. 1, 2002

(54) FUEL ADDITIVE COMPOSITIONS AND FUEL COMPOSITIONS CONTAINING DETERGENTS AND FLUIDIZERS

(75) Inventors: Malcolm G. J. Macduff, Derbyshire (GB); Mitchell M. Jackson, Chagrin Falls, OH (US); David C. Arters, Solon, OH (US); Rodney J. McAtee, Derbyshire (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/518,762

(22) Filed: Mar. 3, 2000

(51) Int. Cl.[7] ..... C10L 1/18; C10L 1/22

(52) U.S. Cl. ..... 44/348; 44/415; 44/412; 44/432; 44/434; 44/443

(58) Field of Search ..... 44/412, 434, 432, 44/415, 443, 348

(56) References Cited

U.S. PATENT DOCUMENTS

| | | | | | |
|---|---|---|---|---|---|
| 3,877,889 | A | * | 4/1975 | Dix | |
| 4,231,759 | A | * | 11/1980 | Udelhofen et al. | |
| 4,298,708 | A | | 11/1981 | Schulze et al. | 521/115 |
| 4,332,595 | A | | 6/1982 | Herbstman et al. | 44/72 |
| 4,396,517 | A | | 8/1983 | Gemmill, Jr. et al. | 252/51.5 |
| 4,464,182 | A | | 8/1984 | Tack et al. | 44/62 |
| 4,526,587 | A | | 7/1985 | Campbell | 44/73 |
| 4,564,372 | A | | 1/1986 | Campbell | 44/71 |
| 4,568,358 | A | | 2/1986 | Courtney | 44/57 |
| 4,600,409 | A | | 7/1986 | Campbell | 44/71 |
| 4,604,103 | A | | 8/1986 | Campbell | 44/72 |
| 4,609,377 | A | | 9/1986 | Sung et al. | 44/56 |
| 4,778,481 | A | | 10/1988 | Courtney | 44/57 |
| 4,944,770 | A | | 7/1990 | Sung | 44/73 |
| 4,964,879 | A | | 10/1990 | Herbstman et al. | 44/434 |
| 4,975,096 | A | | 12/1990 | Buckley, III | 44/433 |
| 5,089,029 | A | | 2/1992 | Hashimoto et al. | 44/432 |
| 5,094,667 | A | | 3/1992 | Shilowitz et al. | 44/434 |
| 5,112,364 | A | | 5/1992 | Rath et al. | 44/418 |
| 5,192,335 | A | | 3/1993 | Cherpeck | 44/387 |
| 5,213,585 | A | | 5/1993 | Oppenlaender et al. | 44/433 |
| 5,242,469 | A | | 9/1993 | Sakakibara et al. | 44/347 |
| 5,264,006 | A | | 11/1993 | Schilowitz et al. | 44/434 |
| 5,298,038 | A | | 3/1994 | Hashimoto et al. | 44/433 |
| 5,387,266 | A | | 2/1995 | Loper | 44/415 |
| 5,503,644 | A | | 4/1996 | Graiff et al. | 44/387 |
| 5,512,067 | A | | 4/1996 | Loper | 44/415 |
| 5,514,190 | A | | 5/1996 | Cunningham et al. | 44/415 |
| 5,634,951 | A | | 6/1997 | Colucci et al. | 44/415 |
| 5,660,601 | A | | 8/1997 | Oppenlander et al. | 44/533 |
| 5,697,988 | A | | 12/1997 | Malfer et al. | 44/415 |
| 5,725,612 | A | | 3/1998 | Malfer et al. | 44/415 |
| 5,873,917 | A | * | 2/1999 | Daly | 44/443 |
| 5,876,468 | A | | 3/1999 | Moreton | 44/415 |

FOREIGN PATENT DOCUMENTS

| | | |
|---|---|---|
| CA | 2089833 | 2/1993 |
| EP | 1132455 A1 | 9/2001 |
| WO | WO 00/49109 | 8/2000 |
| WO | WO 00/61708 | 10/2000 |

OTHER PUBLICATIONS

U.S. application Ser. No. 09/337,997 of McAtee filed Jun. 22, 1999.

* cited by examiner

*Primary Examiner*—Margaret Medley
(74) *Attorney, Agent, or Firm*—Jeffrey F. Munson; Michael F. Esposito

(57) ABSTRACT

The present invention is directed to fuel additive compositions of detergents combined with fluidizers and to hydrocarbon fuel compositions containing these fuel additive compositions.

The fuel additive compositions of the present invention combine a Mannich detergent, formed from reaction of an alkylphenol with an aldehyde and an amine, with a fluidizer that can be a polyetheramine or a polyether or a mixture thereof and, optionally, with a succinimide detergent.

Fuel compositions containing these fuel additive compositions are very effective in reducing intake valve deposits in gasoline fueled engines, especially when the weight ratio of detergent(s) to fluidizer(s) is about 1:1 on an actives basis.

22 Claims, No Drawings

FUEL ADDITIVE COMPOSITIONS AND FUEL COMPOSITIONS CONTAINING DETERGENTS AND FLUIDIZERS

BACKGROUND OF THE INVENTION

1. Field of the Invention

The present invention involves fuel additive compositions and fuel compositions containing these fuel additive compositions. The compositions are effective in reducing intake valve deposits of internal-combustion engines.

2. Description of the Related Art

Deposits in the fuel delivery system and combustion chamber of an internal combustion engine can adversely effect combustion performance in terms of power output and emissions. Consequently, development of more effective fuel additives to prevent and/or reduce deposits is highly desirable.

Canadian Patent Publication 2,089,833, Graiff, Aug. 21, 1993; U.S. Pat. No. 5,697,988, Malfer et al., Dec. 16, 1997; U.S. Pat. No. 5,873,917, Daly, Feb. 23, 1999; and U.S. Pat. No. 5,876,468, Moreton, Mar. 2, 1999, involve Mannich detergents, generally prepared by reaction of alkylphenols with aldehydes and amines, and polyether fluidizers for reduction of deposits in an engine combustion chamber and/or fuel delivery system.

U.S. application Ser. No. 09/337,997, McAtee, filed Jun. 22, 1999, discloses hydrocarbon fuels containing a Mannich detergent composition including other compounds such as polyetheramines.

The present invention provides deposit control fuel additive compositions exhibiting unexpectedly superior results that combine a Mannich detergent with a polyetheramine fluidizer or a polyether fluidizer or a mixture of polyetheramine and polyether fluidizers and, optionally, a succinimide detergent.

SUMMARY OF THE INVENTION

It is an object of this invention to reduce intake system deposits in hydrocarbon-fueled internal combustion engines.

It is a further object of this invention to reduce intake valve deposits in gasoline internal combustion engines.

Additional objects and advantages of the invention will be set forth in part in the description that follows and in part will be obvious from the description or may be learned by the practice of this invention. The objects and advantages of the invention may be realized and attained by means of the instrumentalities pointed out in the appended claims.

To achieve the foregoing objects in accordance with the invention, as described and claimed herein, the fuel additive composition of the present invention comprises a) a Mannich detergent prepared from the reaction of a hydrocarbylphenol, an aldehyde and an amine where the hydrocarbyl substituent has a number average molecular weight of from 500 to 3000, and b) a polyetheramine fluidizer of formula $R[OCH_2CH(R^1)]_nA$ where R is a hydrocarbyl group, $R^1$ is selected from the group consisting of hydrogen, hydrocarbyl groups of 1 to 16 carbon atoms and mixtures thereof, n is a number 2 to about 50, and A is selected from the group consisting of $—OCH_2CH_2CH_2NR^2R^2$ and $—NR^3R^3$ where each $R^2$ is independently hydrogen or hydrocarbyl, and each $R^3$ is independently hydrogen, hydrocarbyl or $—[R^4N(R^5)]_pR^6$ where $R^4$ is $C_2$–$C_{10}$ alkylene, $R^5$ and $R^6$ are independently hydrogen or hydrocarbyl and p is a number from 1–7.

Another aspect of the present invention is a fuel composition comprising a mixture of a hydrocarbon fuel and the above-described fuel additive composition where the concentration of the Mannich detergent and the polyetheramine fluidizer combined on an actives basis is from 10 to 2000 ppm by weight.

A further embodiment of the present invention is the above-described fuel additive composition where the weight ratio on an actives basis of the Mannich detergent to the polyetheramine fluidizer is about 1:0.1–3.

Another embodiment of the present invention is a fuel composition comprising a mixture of a hydrocarbon fuel, hydrocarbon solvent and the above-described fuel additive composition where the weight ratio on an actives basis of the Mannich detergent to the polyetheramine fluidizer is about 1:0.1–3 and the concentration of the detergent and the fluidizer combined is from 10 to 2000 ppm by weight on an actives basis.

In a still further embodiment of the present invention, the fuel additive composition comprises a) a Mannich detergent from the reaction of a hydrocarbyl-substituted phenol, an aldehyde and an amine where the hydrocarbyl substituent is derived from a polyisobutylene having a number average molecular weight of from 500 to 3000 and a vinylidene isomer content of at least 70%, and b) a polyetheramine fluidizer of the formula $R[OCH_2CH(R^1)]_nOCH_2CH_2CH_2NH_2$ where R is $C_1$–$C_{30}$ alkyl group or $C_1$–$C_{30}$ alkyl-substituted phenyl group, $R^1$ is hydrogen, methyl or ethyl, and n is a number from about 10 to about 35 where the weight ratio of the detergent to the fluidizer on an actives basis is about 1:0.5–2.

In yet another embodiment of the present invention, the fuel additive composition comprises (a) a Mannich reaction product of a hydrocarbyl-substituted phenol where the hydrocarbyl substituent has a number average molecular weight of from 500 to 3000, an aldehyde, and an amine, and (b) a polyetheramine represented by the formula $R[OCH_2CH(R1)]_nA$ where R is a hydrocarbyl group, $R^1$ is selected from the group consisting of hydrogen, hydrocarbyl groups of 1 to 16 carbon atoms, and mixtures thereof, n is a number from 2 to about 50, and A is selected from the group consisting of $—OCH_2CH_2CH_2NR^2R^2$ and $—NR^3R^3$ where each R is independently hydrogen or hydrocarbyl, and each $R^3$ is independently hydrogen, hydrocarbyl or $—[R^4N(R^5)]_pR^6$ where $R^4$ is $C_2$–$C_{10}$ alkylene, $R^5$ and $R^6$ are independently hydrogen or hydrocarbyl, and p is a number from 1–7, and (c) a polyether represented by the formula $R^7O[CH_2CH(R^8)O]_qH$ where $R^7$ is a hydrocarbyl group, $R^8$ is selected from the group consisting of hydrogen, hydrocarbyl groups of 1 to 16 carbon atoms, and mixtures thereof, and q is a number from 2 to about 50.

An additional embodiment of the present invention is a fuel additive composition comprising a) a Mannich detergent prepared from the reaction of a hydrocarbyl-substituted phenol, an aldehyde, and an amine where the hydrocarbyl substituent is derived from a polyisobutylene having a number average molecular weight molecular weight of from 500 to 3000 and a vinylidene isomer content of at least 70%, and b) a polyether fluidizer of the formula $R^7O[CH_2CH(R^8)O]_qH$ where $R^7$ is a hydrocarbyl group, $R^8$ is selected from the group consisting of hydrogen, hydrocarbyl groups of 1 to 16 carbon atoms, and mixtures thereof, and q is a number from 2 to about 50, and optionally c) a succinimide detergent prepared from the reaction of a polyamine and a hydrocarbyl-substituted succinic acylating agent where the weight ratio of detergent(s) to fluidizer is about 1:0.5–2 on an actives basis.

In a further additional embodiment of the present invention, the fuel additive composition comprises a) Mannich detergent prepared from the reaction of a hydrocarbyl-substituted phenol, an aldehyde, and an amine where the hydrocarbyl substituent is derived from a polyisobutylene having a number average molecular weight of from 500 to 3000 and a vinylidene isomer content of at least 70%, and b) a polyether fluidizer of the formula $R^7O[CH_2CH(R^8)O]_qH$ where $R^7$ is a hydrocarbyl group, $R^8$ is selected from the group consisting of hydrogen, hydrocarbyl groups of 1 to 16 carbon atoms, and mixtures thereof, and q is a number from 2 to about 50, and optionally c) a succinimide detergent prepared from the reaction of a polyamine and a hydrocarbyl-substituted succinic acylating agent where the weight ratio of detergent(s) to fluidizer is about 1:0.5–2 on an actives basis, and d) a polyetheramine represented by the formula $R[OCH_2CH(R^1)]_nA$ wherein R is a hydrocarbyl group; $R^1$ is selected from the group consisting of hydrogen, hydrocarbyl groups of 1 to 16 carbon atoms, and mixtures thereof; n is a number from 2 to about 50; and A is selected from the group consisting of $—OCH_2CH_2CH_2NR^2R^2$ and $—NR^3R^3$ wherein each $R^2$ is independently hydrogen or hydrocarbyl; and each $R^3$ is independently hydrogen, hydrocarbyl or $—[R^4N(R^5)]_pR^6$ wherein $R^4$ is $C_2$–$C_{10}$ alkylene; $R^5$ and $R^6$ are independently hydrogen or hydrocarbyl; and p is a number from 1–7.

A resulting embodiment of the present invention is a fuel composition comprising a mixture of a hydrocarbon fuel, hydrocarbon solvent and the above-described fuel additive composition of Mannich detergent, polyether fluidizer and optionally succinimide detergent having a weight ratio on an actives basis of detergent(s) to fluidizer of about 1:0.5–2 where the concentration of detergent(s) and fluidizer combined is from 10 to 2000 ppm by weight on an actives basis.

In a still additional embodiment of the present invention, the fuel additive composition comprises a) a Mannich detergent prepared from a hydrocarbyl-substituted phenol, formaldehyde, and ethylenediamine where the hydrocarbyl substitutent is derived from a polyisobutylene having a number average molecular weight of from 500 to 3000 and a vinylidene isomer content of at least 70%, and b) a polyether fluidizer of the formula $R^7O[CH_2CH(R^8)O]_qH$ where $R^7$ is a $C_1$–$C_{30}$ alkyl group or a $C_1$–$C_{30}$ alkyl-substituted phenyl group, $R^8$ is hydrogen, methyl or ethyl, and q is a number from about 10 to about 35, and optionally c) a succinimide detergent prepared from a polyamine and a hydrocarbyl-substituted succinic acylating agent.

A further resulting embodiment of the present invention is a fuel composition comprising a mixture of a hydrocarbon fuel and the above-described fuel additive composition of Mannich detergent prepared from polyisobutylene-derived alkylphenol and formaldehyde and ethylenediamine, polyether fluidizer and optionally succinimide detergent where the concentration of detergent(s) and fluidizer combined is from 10 to 2000 ppm by weight on an actives basis.

Finally in another embodiment of the present invention, the fuel additive composition of Mannich detergent, prepared from phenol alkylated with 500 to 3000 number average molecular weight polyisobutylene having at least 70% vinylidene isomer content and formaldehyde and ethylenediamine, polyether fluidizer and optional succinimide detergent has a weight ratio of detergent(s) to fluidizer of about 1:0.5–2 on an actives basis.

DETAILED DESCRIPTION OF THE INVENTION

The fuel additive compositions of the present invention comprise as a first component a Mannich reaction product of a hydrocarbyl-substituted phenol, an aldehyde, and an amine where the hydrocarbyl substituent has a number average molecular weight from 500 to 3000.

The hydrocarbyl substituent is a univalent radical of one or more carbon atoms that is predominately hydrocarbon in nature, but can have nonhydrocarbon substituent groups and can contain heteroatoms. This description of a hydrocarbyl substituent or group applies throughout the application. The hydrocarbyl substituents are generally derived from polyolefins having a number average molecular weight of from 500 to 3000, preferably 700 to 2300, and most preferably 750 to 1500. The polyolefins are generally derived from polymerization of olefin monomers including ethylene, propylene and various butene isomers including isobutylene. The hydrocarbyl-substituted phenols can be obtained by alkylating phenol with a polyolefin using an alkylation catalyst such as boron trifluoride. Polyisobutylenes can be used to alkylate phenol, and more preferably highly reactive polyisobutylene is used in the alkylation in which at least 70% of the terminal olefinic double bonds in the polyisobutylene are of the vinylidene type. Commercial examples of highly reactive or high vinylidene polyisobutylenes include Ultravis®, formerly marketed by BS Chemical, and Glissopal® marketed by BASF.

The aldehyde is preferably a $C_1$–$C_6$ aldehyde, the most preferred is formaldehyde that may be used in one of its reagent forms such as paraformaldehyde and formalin.

The amine can be a monoamine or a polyamine and includes organic compounds containing at least one HN< group suitable for use in the Mannich reaction. Polyamines include alkylene polyamines such as ethylenediamine, diethylenetriamine and dimethylaminopropylamine.

The conditions required for Mannich reactions to form the Mannich reaction products of this invention are known in the art. For typical conditions for Mannich reactions see U.S. Pat. Nos. 3,877,889, 5,697,988 and 5,876,468, the disclosures of which are incorporated herein by reference.

The fuel additive compositions of the present invention comprise as a second component a fluidizer, for valve stick performance requirements, that can be a polyetheramine or a polyether or a mixture thereof.

The polyetheramines of the present invention are represented by the formula $R[OCH_2CH(R^1)]_nA$ where R is a hydrocarbyl group, $R^1$ is selected from the group consisting of hydrogen, hydrocarbyl groups of 1 to 16 carbon atoms, and mixtures thereof, n is a number from 2 to about 50, and A is selected from the group consisting of $—OCH_2CH_2CH_2NR^2R^2$ and $—NR^3R^3$ where each $R^2$ is independently hydrogen or hydrocarbyl, and each $R^3$ is independently hydrogen, hydrocarbyl or $—[R^4N(R^5)]_pR^6$ where $R^4$ is $C_2$–$C_{10}$ alkylene, $R^5$ and $R^6$ are independently hydrogen or hydrocarbyl, and p is a number from 1–7.

These polyetheramines can be prepared by initially condensing an alcohol or alkylphenol with an alkylene oxide, mixture of alkylene oxides or with several alkylene oxides in sequential fashion in a 1:2–50 mole ratio of hydric compound to alkylene oxide to form a polyether intermediate. U.S. Pat. No. 5,094,667 provides reaction conditions for preparing a polyether intermediate, the disclosure of which is incorporated herein by reference.

The alcohols can be linear or branched from 1 to 30 carbon atoms, more preferably from 6 to 20 carbon atoms, most preferably from 10 to 16 carbon atoms. The alkyl group of the alkylphenols can be 1 to 30 carbon atoms, more preferably 10 to 20 carbon atoms.

The alkylene oxides are preferably ethylene oxide, propylene oxide or butylene oxide. The number of alkylene oxide units in the polyether intermediate is preferably 10–35, more preferably 18–27.

The polyether intermediate can be converted to a polyetheramine by amination with ammonia, an amine or a polyamine to form a polyetheramine of the type where A is —$NR^3R^3$. Published Patent Application EP310875 provides reaction conditions for the amination reaction, the disclosure of which is incorporated herein by reference. Alternately, the polyether intermediate can also be converted to a polyetheramine of the type where A is —$OCH_2CH_2CH_2NR^2R^2$ by reaction with acrylonitrile followed by hydrogenation. U.S. Pat. No. 5,094,667 provides reaction conditions for the cyanoethylation and subsequent hydrogenation, the disclosure of which is incorporated herein by reference.

Polyetheramines where A is —$OCH_2CH_2CH_2NH_2$ are preferred. Commercial examples of preferred polyetheramines are the Techron® range from Chevron and the Jeffamine® range from Huntsman.

The polyethers of the present invention are represented by the formula $R^7O[CH_2CH(R^8)O]_qH$ where $R^7$ is a hydrocarbyl group, $R^8$ is selected from the group consisting of hydrogen, hydrocarbyl groups of 1 to 16 carbon atoms, and mixtures thereof, and q is a number from 2 to about 50. Reaction conditions for preparation as well as preferred embodiments of the polyethers of the present invention were presented above in the polyetheramine description for the polyether intermediate. A commercial example of preferred polyethers is the Lyondell ND® series. Suitable samples are also available from Dow Chemicals, Huntsman, and ICI.

The fuel compositions of the present invention comprise a mixture of the fuel additive composition as described throughout this description and a hydrocarbon fuel. The hydrocarbon fuel is normally a liquid fuel, usually a hydrocarbonaceous petroleum distillate fuel such as motor gasoline as defined by ASTM Specification D439 or diesel fuel or fuel oil as defined by ASTM Specification D396. Normally liquid fuel compositions comprising non-hydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels that are mixtures of one or more hydrocarbonaceous fuels and one or more non-hydrocarbonaceous materials are also contemplated. Examples of such mixtures are combinations of gasoline and ethanol and of diesel fuel and ether. Particularly preferred is gasoline, that is, a mixture of hydrocarbons having an ASTM distillation range from about 60° C. at the 10% distillation point to about 205° C. at the 90% distillation point.

The fuel additive compositions of the present invention can also contain a hydrocarbon solvent to provide for their compatibility or homogeneity and to facilitate their handling and transfer. The hydrocarbon solvent concentration in the fuel additive composition can be 10–80% by weight, preferably 20–70% by weight, and especially preferred being 30–60% by weight. The hydrocarbon solvent can be an aliphatic fraction, aromatic fraction, or mixture of aliphatic and aromatic fractions where the flash point is generally about 40° C. or higher. The hydrocarbon solvent is preferably an aromatic naphtha having a flash point above 62° C. or an aromatic naphtha having a flash point of 40° C. or a kerosene with a 16% aromatic content having a flash point above 62° C.

The fuel additive compositions of the present invention may contain as an optional component a succinimide prepared from a polyamine and a hydrocarbyl-substituted succinic acylating agent. The hydrocarbyl substituent can have a number average molecular weight of about 500 to about 5000, preferably 750 to 1500. The hydrocarbyl substituent can be derived from a polyolefin, preferably polyisobutylene. The polyisobutylene preferably has at least 70% of its olefinic double bonds as the vinylidene isomer type. The polyamine is preferably an alkylene polyamine to include alkylene polyamine bottoms. U.S. Pat. No. 5,719,108 provides a general discussion on preparing hydrocarbyl-substituted succinic acylating agents, the disclosure of which is incorporated herein by reference.

In a preferred embodiment of the present invention, the fuel additive composition comprises a Mannich reaction product detergent, a polyetheramine or polyether fluidizer or mixture thereof, and optionally a succinimide detergent in a weight ratio on an actives basis of detergent(s) to fluidizer(s) of about 1:0.1–3, more preferably 1:0.5–2, and most preferably 1:1–1.3.

In another preferred embodiment of the present invention, the fuel composition comprises a mixture of a hydrocarbon fuel and a fuel additive composition comprising a Mannich reaction product detergent, a polyetheramine or polyether fluidizer or mixture thereof, and optionally a succinimide detergent where the concentration of the detergent(s) and fluidizer(s) combined on an actives basis is from 10 to 2000 ppm by weight, more preferably from 100 to 1000 ppm by weight, and most preferably from 150 to 400 ppm by weight.

The fuel additive compositions and fuel compositions of the present invention can contain other additives that are well known to those of skill in the art. These can include anti-knock agents such as tetra-alkyl lead compounds and MMT (methylcyclopentadienyl manganese tricarbonyl), lead scavengers such as halo-alkanes, dyes, antioxidants such as hindered phenols, rust inhibitors such as alkylated succinic acids and anhydrides and derivatives thereof, bacteriostatic agents, auxiliary dispersants and detergents, gum inhibitors, fluidizer oils, metal deactivators, demulsifiers, anti-valve seat recession additives such as alkali metal sulphosuccinate salts, and anti-icing agents. The fuel compositions of this invention can be lead-containing or lead-free fuels. Preferred are lead-free fuels.

The following examples are set forth only for illustrative purposes.

The test results set forth in Table 1 and Table 2 below demonstrate the superior effectiveness of the fuel additive compositions and the fuel compositions of the present invention in controlling intake valve deposits (IVD) in engine testing.

TABLE 1

| Example | M102E Test[1] Detergent[2], ppm | Fluidizer, ppm | IVD[3], mg |
|---|---|---|---|
| 1 (comparative) | 61 | 133[4] | 209 |
| 2 | 97 | 97[5] | 5 |
| 3 | 97 | 97[6] | 52 |
| 4 | 97 | 97[7] | 12 |
| 5 | 97 | 97[4] | 170 |

TABLE 2

| Example | Renault Clio Field Test[8] Mannich Detergent[2], ppm | Succinimide Detergent[9], ppm | Polyether Fluidizer, ppm | IVD[3], mg |
|---|---|---|---|---|
| 6 (comparative) | 90 | — | 198[4] | 93 |
| 7 | 144 | — | 144[7] | 40 |
| 8 | 113 | 31 | 144[7] | 26 |
| 9 | 113 | 31 | 144[10] | 6.5 |
| 10 | 72 | 72 | 144[7] | 0.5 |

1. Daimler-Benz M102E Test: 4-cylinder, 4-stroke, 2.3 liter gasoline engine, 60 hours on dynamometer with variable speed and load cycle.
2. Mannich from 1000 molecular weight polyisobutylene alkylated phenol, formaldehyde and ethylenediamine in 1:1:1 molar ratio.
3. Average valve deposit weight.
4. Polyether from dodecylphenol and average of 11 propylene oxide units.
5. Polyetheramine via cyanoethylation and hydrogenation of polyether from $C_{13}$ alcohol and average of 20 butylene oxide units.
6. Polyether from $C_{13}$ alcohol and average of 20 butylene oxide units.
7. Polyether from $C_{12-15}$ alcohol and average of 24 propylene oxide units.
8. Renault Clio Field Test: 4-cylinder, 4-stroke, 1.1 liter, single-point injection gasoline engine; 10,000 km with 70% highway and 30% urban cycle.
9. Succinimide from 1000 molecular weight polyisobutylene thermally alkylated succinic anhydride and alkylene polyamine bottoms in 1:0.87 mole ratio.
10. Polyether from dodecylphenol and average of 24 propylene oxide units.

What is claimed is:

1. A fuel additive composition, consisting essentially of:

(a) a Mannich reaction product of a hydrocarbyl-substituted phenol wherein the hydrocarbyl substituent has a number average molecular weight of from 750 to 1500; an aldehyde; and an amine; and (b) a polyetheramine represented by the formula $R[OCH_2CH(R^1)]_nA$ wherein R is a hydrocarbyl group derived from an alcohol having 6 to 20 carbon atoms or an alkylphenol wherein the alkyl group has 10 to 20 carbon atoms; $R^1$ is hydrogen, methyl, or ethyl; n is a number from 10 to 35; A is selected from the group consisting of $—OCH_2CH_2CH_2NR^2R^2$ and $—NR^3R^3$ wherein each $R^2$ is independently hydrogen or hydrocarbyl; and each $R^3$ is independently hydrogen, hydrocarbyl or $—[R^4N(R^5)]_pR^6$ wherein $R^4$ is $C_2$–$C_{10}$ alkylene; $R^5$ and $R^6$ are independently hydrogen or hydrocarbyl; and p is a number from 1–7; and wherein the weight ratio on an actives basis of the Mannich reaction product to the polyetheramine is 1:1–1.3.

2. A fuel composition, comprising:

a hydrocarbon fuel; and the fuel additive composition of claim 1 wherein the concentration of the Mannich reaction product and the polyetheramine combined is from 100 to 1000 ppm by weight.

3. The fuel additive composition of claim 1 wherein the weight ratio of the Mannich reaction product to the polyetheramine is about 1:1.

4. The fuel additive composition of claim 3, further comprising:

(c) a hydrocarbon solvent.

5. A fuel composition, comprising:

a hydrocarbon fuel; and the fuel additive composition of claim 4 wherein the concentration of the Mannich reaction product and the polyetheramine combined is from 100 to 1000 ppm by weight.

6. The fuel additive composition of claim 1 wherein the hydrocarbyl substituent of the Mannich reaction product is derived from a polyisobutylene having a vinylidene isomer content of at least 70%.

7. A fuel composition, comprising:

a hydrocarbon fuel; and the fuel additive composition of claim 6 wherein the concentration of the Mannich reaction product and the polyetheramine combined is from 100 to 1000 ppm by weight.

8. The fuel additive composition of claim 6 wherein n of the polyetheramine is a number from about 18 to 27; and A of the polyetheramine is $—OCH_2CH_2CH_2NH_2$.

9. A fuel composition, comprising:

a hydrocarbon fuel; and the fuel additive composition of claim 8 wherein the concentration of the Mannich reaction product and the polyetheramine combined is from 100 to 1000 ppm by weight.

10. The fuel additive composition of claim 8 wherein the weight ratio of the Mannich reaction product to the polyetheramine is about 1:1.

11. The fuel additive composition of claim 10, further comprising:

(c) a hydrocarbon solvent.

12. A fuel composition, comprising:

a hydrocarbon fuel; and the fuel additive composition of claim 11 wherein the concentration of the Mannich reaction product and the polyetheramine combined is from 100 to 1000 ppm by weight.

13. The fuel additive composition of claim 1, further consisting essentially of:

(d) a polyether represented by the formula $R^7O[CH_2CH(R^8)O]_qH$ wherein $R^7$ is a hydrocarbyl group; $R^8$ is selected from the group consisting of hydrogen, hydrocarbyl groups of 1 to 16 carbon atoms, and mixtures thereof; and q is a number from 2 to about 50 wherein the weight ratio of the Mannich reaction product to the polyetheramine and the polyether combined is 1:1–1.3.

14. A fuel additive composition, consisting essentially of:

(a) a Mannich reaction product of a hydrocarbyl-substituted phenol wherein the hydrocarbyl substituent is derived from a polyisobutylene having a number average molecular weight of from 750 to 1500 and a vinylidene isomer content of at least 70%; an aldehyde; and an amine; and (b) a polyether represented by the formula $R^7O[CH_2CH(R^8)O]_qH$ wherein $R^7$ is a hydrocarbyl group derived from a $C_6$–$C_{20}$ alcohol or an alkylphenol wherein the alkyl group has 10 to 20 carbon atoms; $R^8$ is selected from the group consisting of hydrogen, methyl, and ethyl; and q is a number from 10–35; and optionally (c) a succinimide prepared from a polyamine and a hydrocarbyl-substituted succinic acylating agent wherein the hydrocarbyl substituent of the acylating agent has a number average molecular weight of 750 to 1500; and wherein the weight ratio on an active basis of the Mannich reaction product and the succinimide combined to the polyether is 1:1–1.3.

15. The fuel additive composition of claim 14, further consisting essentially of:

(d) a polyetheramine represented by the formula $R[OCH_2CH(R^1)]_nA$ wherein R is a hydrocarbyl group; $R^1$ is selected from the group consisting of hydrogen, hydrocarbyl groups of 1 to 16 carbon atoms, and mixtures thereof; n is a number from 2 to about 50; and A is selected from the group consisting of $—OCH_2CH_2CH_2NR^2R^2$ and $—NR^3R^3$ wherein each $R^2$ is independently hydrogen or hydrocarbyl; and each $R^3$ is independently hydrogen, hydrocarbyl or $—[R^4N(R^5)]_pR^6$ wherein $R^4$ is $C_2$–$C_{10}$ alkylene; $R^5$ and $R^6$ are independently hydrogen or hydrocarbyl; p is a number from 1–7; and wherein the weight ratio of the Mannich reaction product and the succinimide combined to the polyether and the polyetheramine combined is 1:1–1.3.

16. The fuel additive composition of claim 14, further comprising:

(e) a hydrocarbon solvent.

17. A fuel composition, comprising:

a hydrocarbon fuel; and the fuel additive composition of claim 16 wherein the concentration of the Mannich reaction product, the polyether and the succinimide combined is from 100 to 1000 ppm by weight.

18. The fuel additive composition of claim 14 wherein the aldehyde and the amine of the Mannich reaction product are respectively formaldehyde and ethylenediamine.

19. A fuel composition, comprising:

a hydrocarbon fuel; and the fuel additive composition of claim 18 wherein the concentration of the Mannich reaction product, the polyether and the succinimide combined is from 100 to 1000 ppm by weight.

20. The fuel additive composition of claim 18 wherein the weight ratio of the Mannich reaction product and the succinimide combined to the polyether is about 1:1.

21. The fuel additive composition of claim 20, further comprising:

(d) a hydrocarbon solvent.

22. A fuel composition, comprising:

a hydrocarbon fuel; and the fuel additive composition of claim 21 wherein the concentration of the Mannich reaction product, the polyether and the succinimide combined is from 100 to 1000 ppm by weight.

* * * * *